US006088890A

United States Patent [19]

Burke et al.

[11] Patent Number: 6,088,890

[45] Date of Patent: Jul. 18, 2000

[54] SAFETY BELT BUCKLE

[75] Inventors: David Burke; Ian Alexander Gordon, both of Carlisle; Alan George Smithson, Edmond Castle, all of United Kingdom

[73] Assignee: Breed Automotive Technology, Inc., Lakeland, Fla.

[21] Appl. No.: 09/052,599

[22] Filed: Mar. 31, 1998

[30] Foreign Application Priority Data

Apr. 2, 1997 [GB] United Kingdom ..... 9706643

[51] Int. Cl.[7] ..... A44B 11/26

[52] U.S. Cl. ..... 24/633; 24/641

[58] Field of Search ..... 24/633, 625, 628, 24/637, 632, 639, 642, 641, 662, 654, 640, 650; 297/468, 480

[56] References Cited

U.S. PATENT DOCUMENTS

| | | | |
|---|---|---|---|
| 5,115,543 | 5/1992 | Föhl | 24/633 |
| 5,195,224 | 3/1993 | Bock et al. | 24/641 |
| 5,213,365 | 5/1993 | Föhl | 24/633 X |
| 5,496,068 | 3/1996 | Ball et al. | 24/633 X |
| 5,595,400 | 1/1997 | Wier | 24/633 X |
| 5,596,795 | 1/1997 | Beisswenger | 24/633 |
| 5,742,987 | 4/1998 | Mikulec et al. | 24/633 X |
| 5,765,266 | 6/1998 | Betz | 24/633 |

FOREIGN PATENT DOCUMENTS

| | | |
|---|---|---|
| 0212507 | 3/1987 | European Pat. Off. . |
| 0489950 | 6/1992 | European Pat. Off. . |
| 0507266 | 10/1992 | European Pat. Off. . |
| 0663156 | 7/1995 | European Pat. Off. . |
| 2241019 | 8/1991 | United Kingdom . |

*Primary Examiner*—James R. Brittain
*Assistant Examiner*—Robert J. Sandy
*Attorney, Agent, or Firm*—Lonnie Drayer; Beth Vrioni

[57] ABSTRACT

A buckle for a vehicle safety restraint for use with a pretensioner has an actuating button for operating a latch for the tongue of the safety restraint. The button is connected via pulleys to a counterbalancing mass. When the pretensioner is operated and the buckle is retracted, the inertia of the mass counteracts the inertia of the button. Thus the button is prevented from moving in relation to the buckle in a direction which would tend to unlatch the tongue of the safety restraint.

7 Claims, 2 Drawing Sheets

SAFETY BELT BUCKLE

The present invention relates to a buckle for a vehicle occupant safety restraint belt and particularly to a buckle suitable for use with a pretensioner.

Pretensioners are devices which rapidly withdraw a length of safety belt to take up slack in the event of a crash. The vehicle occupant is thereby more securely restrained and is more correctly positioned to benefit from secondary restraints such as airbags which are dependent upon the correct positioning of the vehicle occupant for maximum effect.

A pretensioner may be used at the retractor end of the belt to rapidly rewind belt webbing onto the retractor reel or alternatively at the buckle end to rapidly withdraw the buckle mounting in a belt tightening direction. It is preferred to use the pretensioner at the buckle end since pulling back the buckle a particular distance effectively tightens the belt by twice the distance (a length of webbing is removed from each of the lap and shoulder portions).

However a problem arises in a buckle pretensioner in that the high acceleration forces generated by the pretensioner acting on movable parts of the buckle tend to cause a normal buckle to unlatch with evidently undesirable consequences to the safety of the vehicle occupant.

A safety belt buckle comprises a frame attached to one piece of belt webbing, a guide channel for a tongue attached to another piece of webbing, a latching member which is movable, either slidingly or pivotally, through the action of an actuating button accessible to the user, between a latched position in which is engages the tongue and a detached position in which the tongue is free. Advantageously an overlooking member is also incorporated to block the latching member and protect the buckle from transverse shocks tending to move the latch into the unlatched position. This may take the form of an abutment on the button engaging the latching member or an overlooking rod or pin which rests on top of the latching member to hold it down. For unlatching the buckle, such a rod is moved out of the way by the actuating button. It will be seen that pretensioning forces on the buckle act in the tongue insertion forces on the buckle act in the tongue insertion direction and thus act on the button and overlocker in an unlatching direction, causing undesirable spurious release.

In order to prevent this spurious release adaptations have been made to buckles. It has been suggested to physically block release of the buckle under pretensioning forces using pivoting pawls or additional locking devices which move, under pretensioning forces, into positions in which either the tongue engagement or in which the release button is blocked from moving in the release direction.

These known blocking systems have disadvantages in that they rely on a physical movement of a part and thus are prone to wear and to failure through ingress of direct or foreign bodies into the buckle. They rely on the additional locking member moving faster than the buckle button under pretensioning forces, and their speed of movement will be affected by environmental conditions.

It has also been suggested to counteract the inertia of the button by incorporating a balancing mass into the design such that the inertia of the mass acts in the opposite direction to the inertia of the button.

It is known from GB 2 241 019 to use a balancing mass resiliently connected to the overlooking pin under the influence of pretensioning forces and prevent it from moving out of the overlooking position, thus maintaining the buckle in the latched state. However this arrangement relies on the strength and resilience of a small leaf spring and failure of the spring through wear is likely over time, particularly since the spring flexes each time the buckle is latched and detached under normal operating conditions. In addition this arrangement provides no protection against forces generated during the acceleration or pretensioning phase of the pretensioner (the down stroke). The acceleration phase does not tend specifically to unlatch a buckle since the forces act on the movable parts such as the button in a direction counter to the unlatching direction. The forces nonetheless cause relative movement which must be restricted by stops built into the housing frame and button and this adds to the complexity and thus the cost of construction. In addition the constant contact of physical parts causes wear and thus introduces elements of possible failure.

Another known buckle intended for use with a pretensioner is described in EP 0663156. This uses a mass pivotally connected to the button by a rigid two-armed lever and via a spring to the tongue ejector. This buckle has an undesirably large width to accommodate the pivoting lever-mass arrangement.

The present invention aims to provide an improved buckle adapted for use with a pretensioner.

According to the present invention, there is provided a buckle for use with a pretensioner, capable of resisting high acceleration and deceleration forces, the buckle comprising:

a frame;

a channel in the frame, into which a tongue can be inserted;

a latch member movable from a position in which a tongue is engaged and a position in which the tongue is released;

an actuating member movable in two opposing directions parallel to the line of insertion of the tongue and operatively associated with the latch member so as to the capable of moving the latch member between the tongue engaged and the tongue disengaged positions; and a counterbalance member arranged to compensate for acceleration and deceleration forces which tend to move the actuating member in either of said two directions; wherein the actuating member and the counterbalance member both have their center of mass in generally the same plane as the line of action of the actuating member, and the buckle comprising a linear two-directional reverse inertial transfer connection so that the inertia of one is directly transferred to the other in a reverse direction, the mass of the actuating member being approximately equal to the mass of the counterbalance member.

Preferably the connection is a flexible cable threaded in a continuous loop around pulleys attached to the frame. The button and the mass are each connected to different sides of the loop so that any forces acting on one will act on the other in an opposite direction. The connection may be fixed or by means of further pulleys attached to the button. The cable then winds in a continuous figure 8, the top loop circling the button pulley and the bottom loop circling two frame mounted pulleys.

The cable is made of a fine, very strong, material which does not stretch or distort in use. A fine, strong wire may be used or synthetic material such as Kevlar® would be suitable.

For a better understanding of the present invention and to show how the same may be carried into effect, reference will now be made to the accompanying drawings in which.

Figure 1:
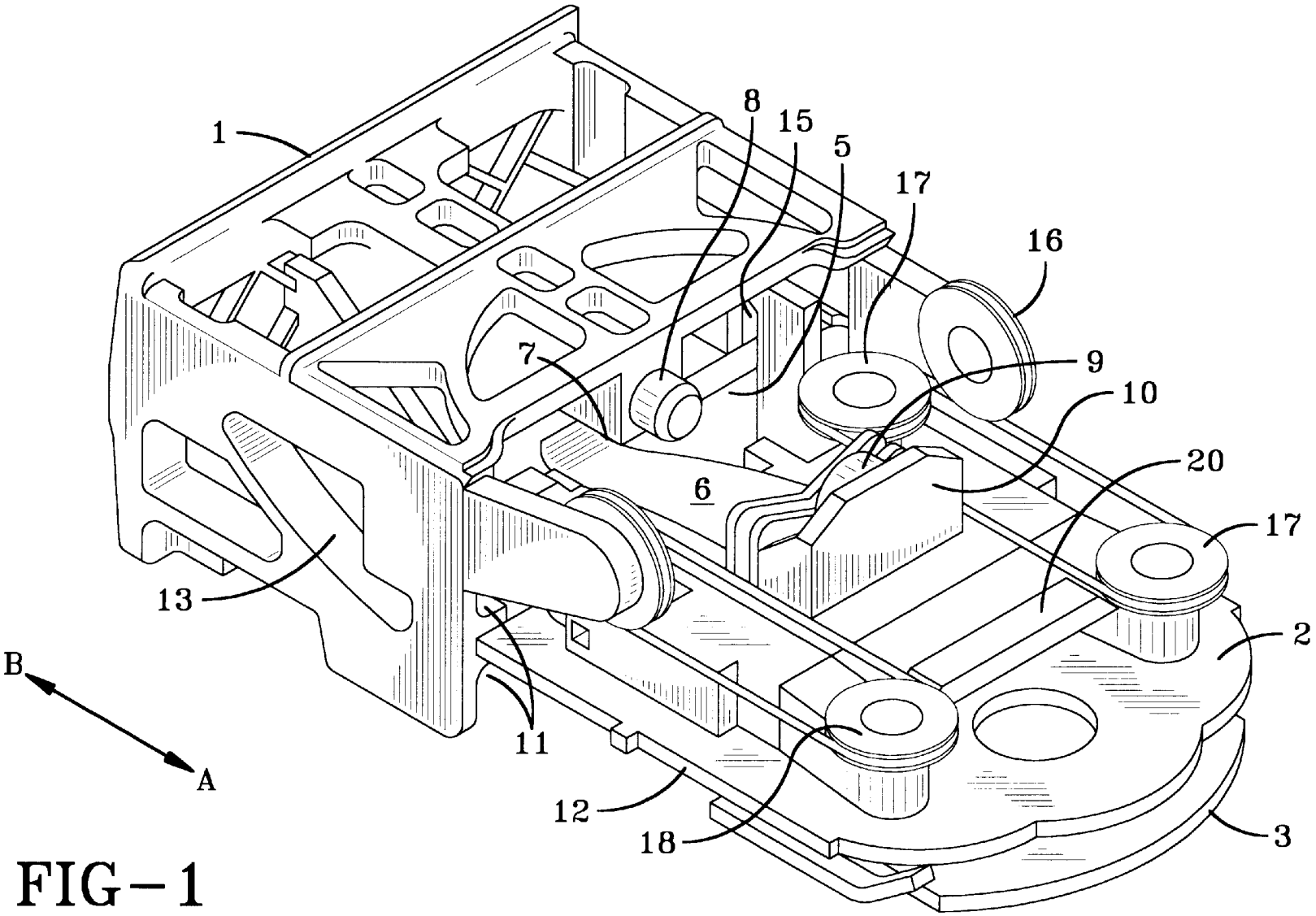
FIG. 1 is a perspective view of a buckle according to the present invention, with its top cover removed.
Figure 2:
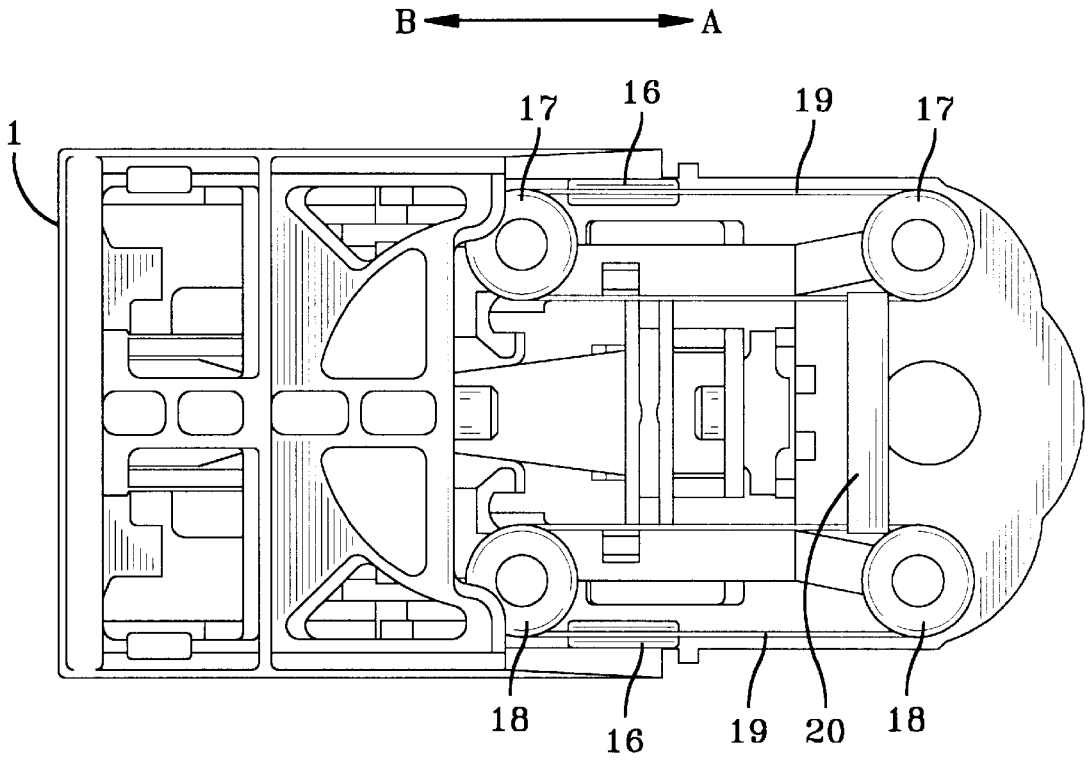
FIG. 2 is a top plan view of the buckle of FIG. 1.
Figure 3:
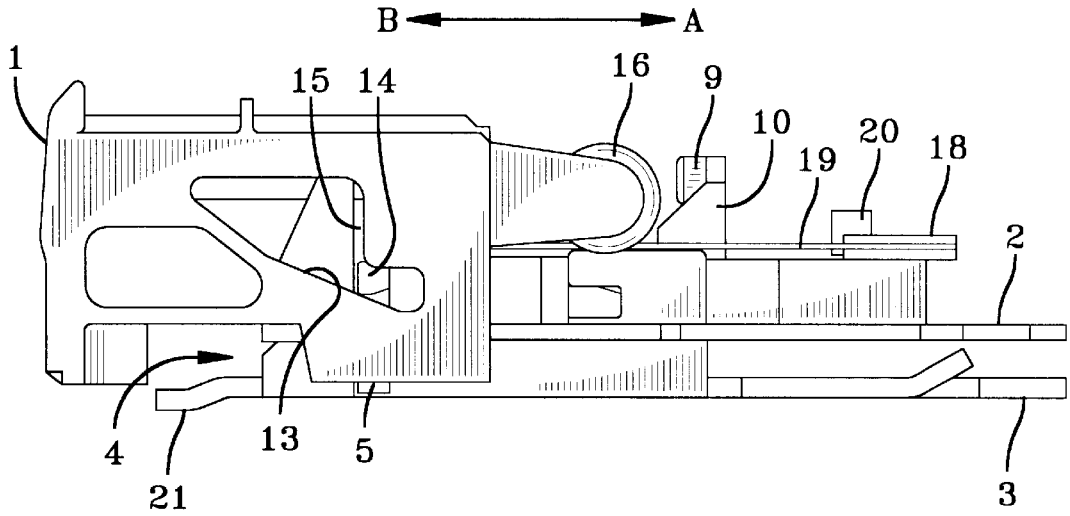
FIG. 3 is a side view of the buckle of FIG. 1.

The Figures show an actuating button 1 slidably mounted in two frame parts 2 and 3 which define a channel 4 between them for receiving a buckle tongue 21 to be latched into the buckle. A latch member 5 is movable transversely across the part of channel 4 so as to locate and engage through a hole in the buckle tongue. The latch member 5 is biased into a latching position by a leaf spring 6 acting on its upper edge 7. The button 1 is spring biased by a return spring (not shown) which acts between the upper frame part 2 and the button 1 and is supported at the button side by a spring mounting lug 8. On the frame side the spring engages a spring mounting lug 9 on an upwardly extending arm 10.

The button slides parallel to the tongue insertion channel 4 by means of flanges 11 engaging above and below slide edges 12 of the upper frame part 2.

The button 1 has side ramps 13 and these cooperate with side extending arms 14 on the latch member 5. As the button moves in direction A, the latch side arms 14 ride up the respective ramps and the latch is lifted, guided in side channels 15, out of the tongue receiving channel and out of engagement with the tongue. This is the release position.

Mounted on rear extensions of the button are guide wheels 16, facing inwardly of the buckle and fixed securely to the button extensions against rotation rotatable about their centers. Four further pulley wheels are mounted in pairs 17, 18 on each side of the frame, and these are freely rotatable about their centers.

A flexible wire 19 passes in a continuous loop around each pair of frame pulley wheels 17, 18 and around the respective button pulley wheel 16, i.e., that which is located on the same side of the buckle. The wire 19 forms a figure 8 with the lower loop passing over a pair of frame wheels 17, 18 and the upper loop circling the respective button wheel 16.

Attached between the inner lengths of wire 19 is a counterbalance mass 20 which is fixedly secured to the wire either by crimping or clamping or it may be glued or riveted or attached by other suitable methods.

In normal operation, to release the buckle, the button 1 is depressed (in the direction A). The side ramps 13 lift the latch member 5, against the bias of the leaf spring 6, and the tongue is released. As the button is depressed in the direction A the button guide wheels 16 move in the direction A, and this, via wire 19, causes the frame pulley wheels 17, 18 to rotate and thus the mass, carried on the inner length of wire 19 moves in direction B.

When the buckle unlatching operation is complete the button returns to its rest position under action of the button return spring.

Thus the button moves in direction B (opposite to direction A). The frame pulley wheels 17, 19 now rotate in opposite direction and the mass moves in the direction A.

Operation of the buckle under pretensioning conditions will now be described.

When a buckle pretensioner is detonated, the buckle frame parts 2 and 3 are accelerated downwardly in the vehicle, in the direction of arrow A in the Figures. Since the button 1 is not fixed to the frame it experiences a relative inertial force in the opposite direction, i.e., during the acceleration phase of the pretensioning operation, the button lags behind the frame. At the end of the pretensioning stroke, the frame comes to an abrupt halt. However the inertia of the button provides a force tending to cause it to keep moving in the direction A. Unchecked, this relative movement of the button in direction A will unlatch the buckle. However with this invention, the inertia of the button is countered by the inertia of the mass 20.

During the acceleration phase the mass 20 also experiences a relative inertial force, compared to the frame, so that it lags behind the frame in the direction B.

However this inertia is transferred from the mass to the button in the opposite sense, via the wire the pulley arrangement and counteracts the inertia of the button. Friction between the wire and the button guide wheels is sufficient to effectively lock the wire 19 to the button guide wheels 16 so that the button is effectively fixedly connected to the wire.

At the end of the pretensioning stroke when the frame is stopped and the inertia of the button acts to keep it moving in the direction A, the inertia of the counterbalance mass also acts in direction A and this is transferred through the wire and pulley arrangement to counteract the inertial forces on the button. Again, the wire is locked to the button guide wheels 16 due to the friction of the wire.

Thus, during pretensioning, in either the acceleration or the deceleration phase, there is no actual relative movement of parts of the buckle since the inertia of the button and of the mass counteract each other. Hence no spurious unlatching will occur and the buckle remains securely latched under large forces in any direction.

The button may alternatively be directly connected to the wire 19, in the same way as is the mass. Under pretensioning conditions this will operate in the same way as the illustrated embodiment. The fixed button guide wheels are however a convenient way of attaching an endless wire to the button, and the 360° lap round gives the maximum frictional contact.

We claim:

1. A buckle for use with a pretensioner comprising:

a frame;

a channel in the frame, for receiving a tongue substantively along a line of insertion;

a latch member movable between a position in which a tongue in engaged and a position in which the tongue is released;

an actuating member movable in two opposing directions along a line of action substantively parallel to the line of insertion of the tongue, and operatively associated with the latch member so as to be capable of moving the latch member between the tongue released positions; and a counterbalance member arranged to compensate for acceleration and deceleration forces which tend to move the actuating member in either of the said two directions, wherein the actuating member and the counterbalance member both have their center of mass in generally the same plane in which the line of action of the actuating member lies, and the buckle comprises a linear two-directional reverse inertial transfer connection, such that the inertia of one of the counterbalance member and the actuating member is directly transferred to the other one of the counterbalance member and the actuating member in a reverse direction, the mass of the actuating member being approximately equal to the mass of the counterbalance member.

2. The buckle of claim 1 wherein the inertial transfer connection is a flexible cable threaded in a continuous loop around pulleys attached to the frame.

3. The buckle of claim 2 wherein the actuating member and the counterbalance member are each connected to different sides of the loop, such that forces acting on one act on the other in an opposite direction.

4. The buckle of claim 3 wherein the loop is connected to the actuating member by a further pulley attached to the actuating member.

5. The buckle of claim 4, wherein the pulleys attached to the frame comprise a pair of pulleys attached to the frame, and the cable winds in a continuous figure 8, a top loop of which circles the pulley attached to the actuating member, and a bottom loop of which circles the pair of frame mounted pulleys.

6. The buckle of claim 5 wherein the transfer connection comprises a pair of flexible cables, two pulleys being provided on the actuating member, and two pairs of pulleys being provided on the frame.

7. The buckle of claim 2 wherein the cable comprises a fine, very strong, material which does not significantly stretch or distort in use.

* * * * *